US007233751B2

(12) United States Patent
Nishida

(10) Patent No.: US 7,233,751 B2
(45) Date of Patent: Jun. 19, 2007

(54) IMAGE FORMING APPARATUS

(75) Inventor: Ikuo Nishida, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 21 days.

(21) Appl. No.: 10/921,578

(22) Filed: Aug. 18, 2004

(65) Prior Publication Data

US 2006/0039714 A1 Feb. 23, 2006

(51) Int. Cl.
*G03G 15/00* (2006.01)

(52) U.S. Cl. ..... 399/82; 399/85; 399/397; 399/405

(58) Field of Classification Search ..... 399/82, 399/85, 397, 405; 271/279, 288, 290
See application file for complete search history.

(56) References Cited

U.S. PATENT DOCUMENTS 6,422,557 B1 * 7/2002 Kakigi ..... 271/294
2003/0053101 A1 * 3/2003 Matsumoto ..... 358/1.13
2004/0085583 A1 * 5/2004 Yamamura ..... 358/1.15

FOREIGN PATENT DOCUMENTS

JP 3-152055 6/1991

* cited by examiner

*Primary Examiner*—David M. Gray
*Assistant Examiner*—Laura K. Roth
(74) *Attorney, Agent, or Firm*—SoCal IP Law Group LLP; Steven C. Sereboff; M. Kala Sravaiya

(57) ABSTRACT

An image forming apparatus comprising a main body having a copy function of printing an image read from a document on a paper sheet, a printer function of printing an externally input image on a paper sheet, and a paper ejection port to eject a printed paper sheet. The apparatus also includes a paper ejection unit which has a first tray and a second tray for receiving a paper sheet ejected form the paper ejection port, and moves the trays selectively to the positions corresponding to the paper ejection port. The apparatus also includes a control panel for setting an operating condition of the apparatus, and a state key provided on the control panel and configured to operate when holding the trays at current positions.

8 Claims, 8 Drawing Sheets

IMAGE FORMING APPARATUS

BACKGROUND OF THE INVENTION

1. Field of the Invention

The present invention relates to an image forming apparatus having a paper ejection unit to receive a printed paper sheet.

2. Description of the Related Art

A paper sheet printed by an image forming apparatus is ejected to a tray of the main body of the apparatus or a paper ejection unit (also called a finisher) equipped on the main body. The paper ejection unit has a plurality of trays, for example, two divided into upper and lower sides, to receive paper sheets ejected from the main body, and moves these trays to a paper ejection port of the main body.

There is a multifunction image forming apparatus (called an MFP), which has multiple functions including a printer function of printing an external image input from a network or the like on a paper sheet, in addition to an ordinary copy function of printing an image read from a document on a paper sheet. In the multifunction image forming apparatus equipped with the paper ejection unit, a paper sheet printed by the copy function is ejected to the upper side tray, and a paper sheet printed by the printer function is ejected to the lower side tray. Namely, the upper side tray is used for copying, and the lower side tray is used for printing.

However, at the end of printing by the printer function, the lower side tray for printing is left being set at the position corresponding to the paper ejection port of the main body. Thus, even if a copy job is input after the end of printing by the printer function, printing is not started at once. Printing will be started after the upper side tray for copying is moved to the paper ejection port of the main body (after the preparation for printing by the copy function is completed). The user must wait for a long time in front of the main body until printing is started after a copy job is input.

BRIEF SUMMARY OF THE INVENTION

The present invention has been made to solve the above problem. It is an object of the invention to provide an image forming apparatus which can start printing without having the user wait for the printing.

According to an aspect of the invention is to provide an image forming apparatus comprising:

a main body having a copy function of printing an image read from a document on a paper sheet, a printer function of printing an externally input image on a paper sheet, and a paper ejection port to eject a printed paper sheet:

a paper ejection unit which has a first tray and a second tray for receiving a paper sheet ejected from the paper ejection port, and moves the trays selectively to the position corresponding to the paper ejection port;

an operating section configured to operate when holding the trays at current positions;

a first control part configured to start printing by the copy function after setting the first tray at the position corresponding to the ejection port, if the operating section is not operated when a copy job for printing by the copy function is entered;

a second control part configured to start printing by the copy function while holding the trays of the paper ejection unit at the current positions, if the operating section is operated when a copy job for printing by the copy function is entered; and a third control part configured to start printing by the printer function after setting the second tray at the position corresponding to the paper ejection port, when a print job for printing by the printer function is entered.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

[1] A first embodiment of the present invention will be explained hereinafter with reference to the accompanying drawings.

Figure 1:
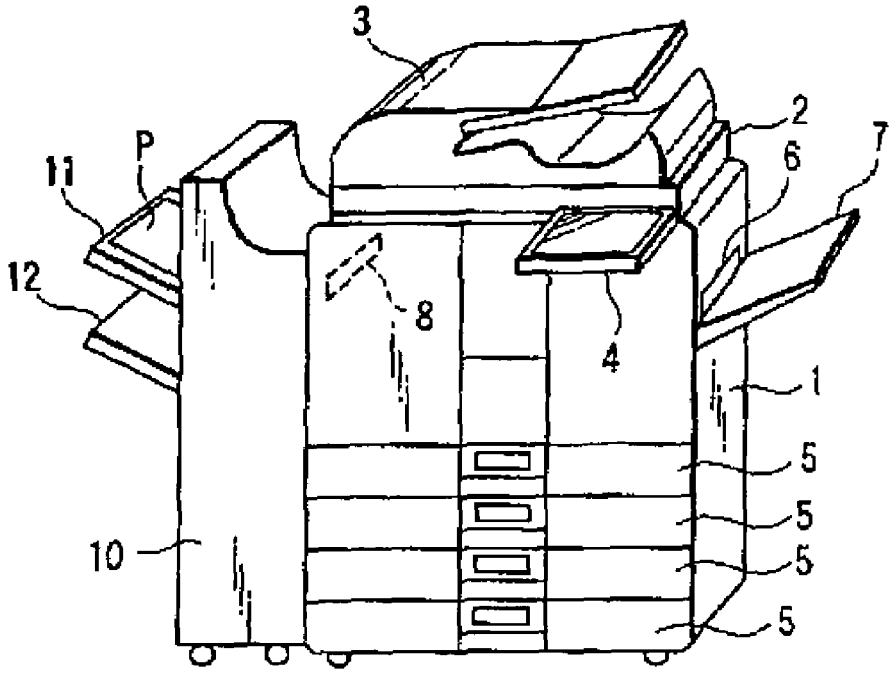
FIG. 1 is a perspective showing the external view of each embodiment of the invention.

As shown in FIG. 1, a document table 2 is provided at the top of a main body 1 of an image forming apparatus, and an automatic document feeder (ADF) 3 is provided openably in the upper part of the document table 2. A control panel 4 for setting the operating condition is provided at the same level as the document table 2. Cassettes 5 containing various sizes of paper sheets are provided in the lower part of the main body 1.

Figure 2:
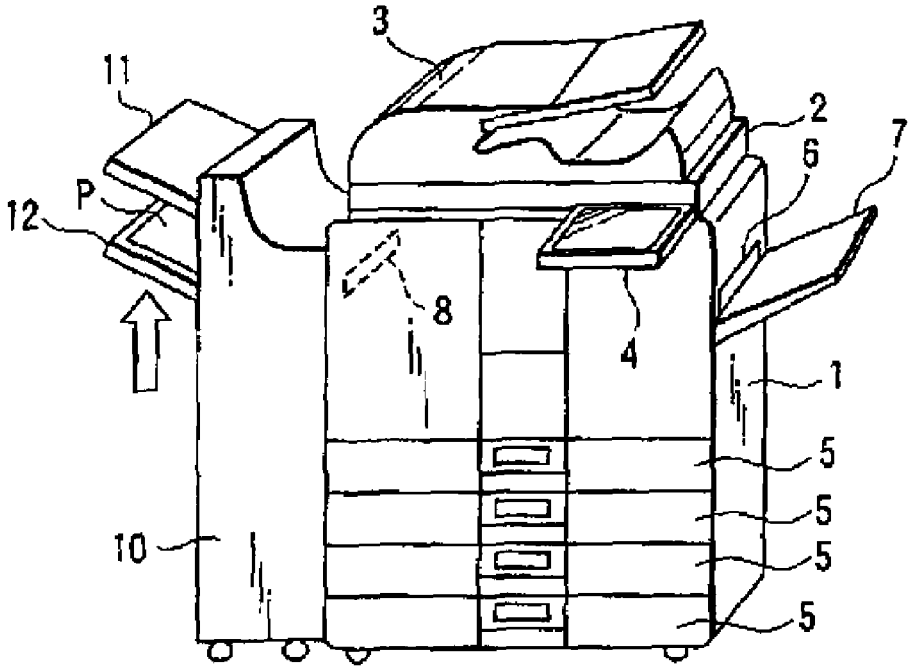
FIG. 2 is a perspective showing the external view of each embodiment of the invention, and movement of trays.

A paper sheet printed in the main body 1 is ejected to a tray (a main body tray) 7 from a paper ejection port 6 on the side of the main body 1. A paper ejection port 8 is formed on the other side of the main body 1, and a paper ejection unit 10 is equipped on the side with the paper ejection port 8. The paper ejection unit 10 has an upper side tray 11 (called an upper tray) and a lower side tray 12 (called a lower tray) to receive a paper sheet ejected from the paper ejection port 8. These trays 11 and 12 are movable upward and downward. FIG. 1 shows the state that the upper tray 11 is set at the position corresponding to the paper ejection port 8, and a paper sheet P is ejected to the upper tray 11. FIG. 2 shows the state that the trays 11 and 12 are moved upward, the lower tray 12 is set at the position corresponding to the paper ejection port 8, and a paper sheet P is ejected to the lower tray 12.

Figure 3:
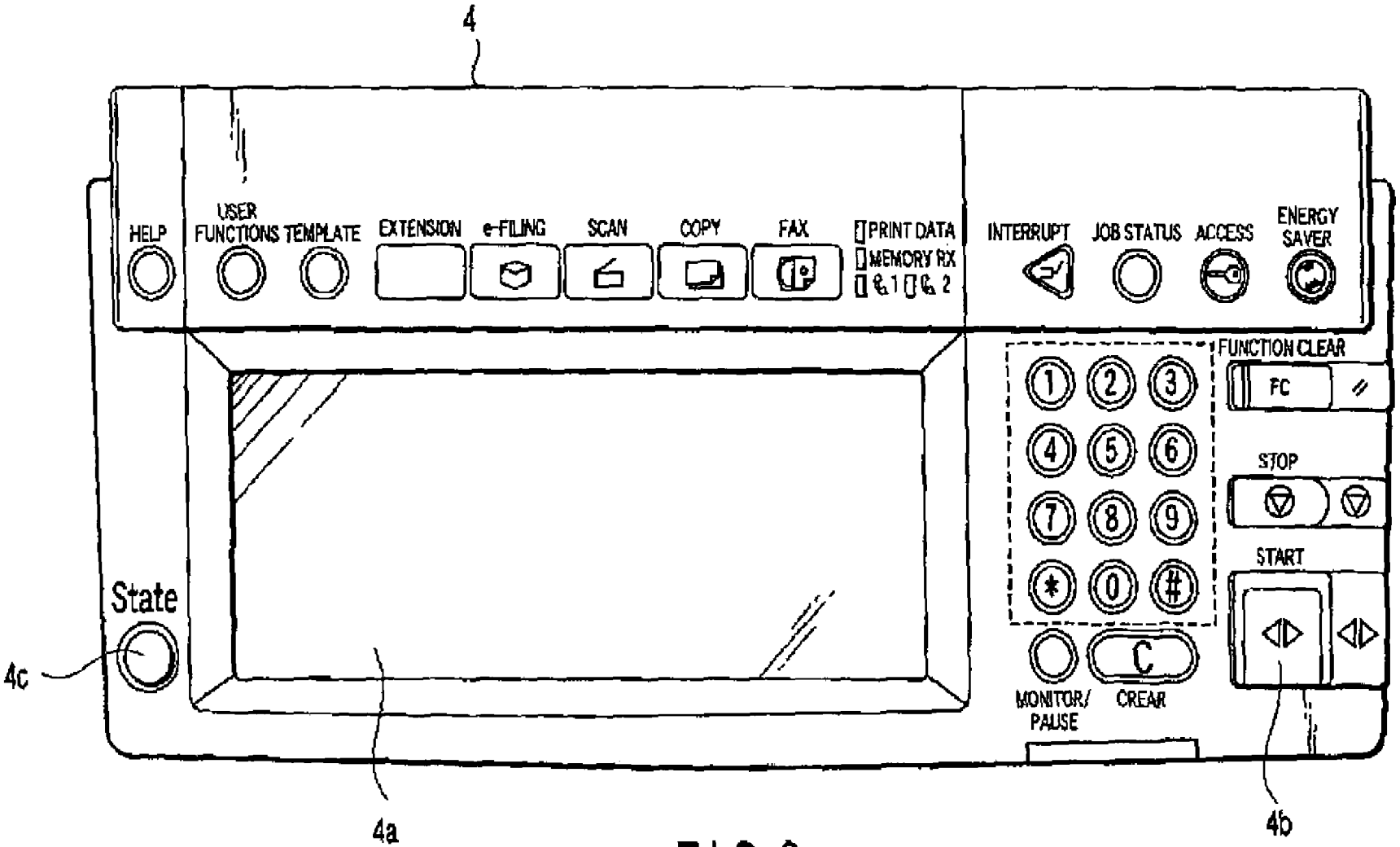
FIG. 3 is a view showing the configuration of the control panel of each embodiment of the invention.

The control panel 4 has a liquid crystal display 4*a*, a start key 4*b* and a state key 4*c*, as main components, as shown in FIG. 3. The state key 4*c* serves as a control section when holding the trays 11 and 12 of the paper ejection unit 10 at the current positions.

Figure 4:
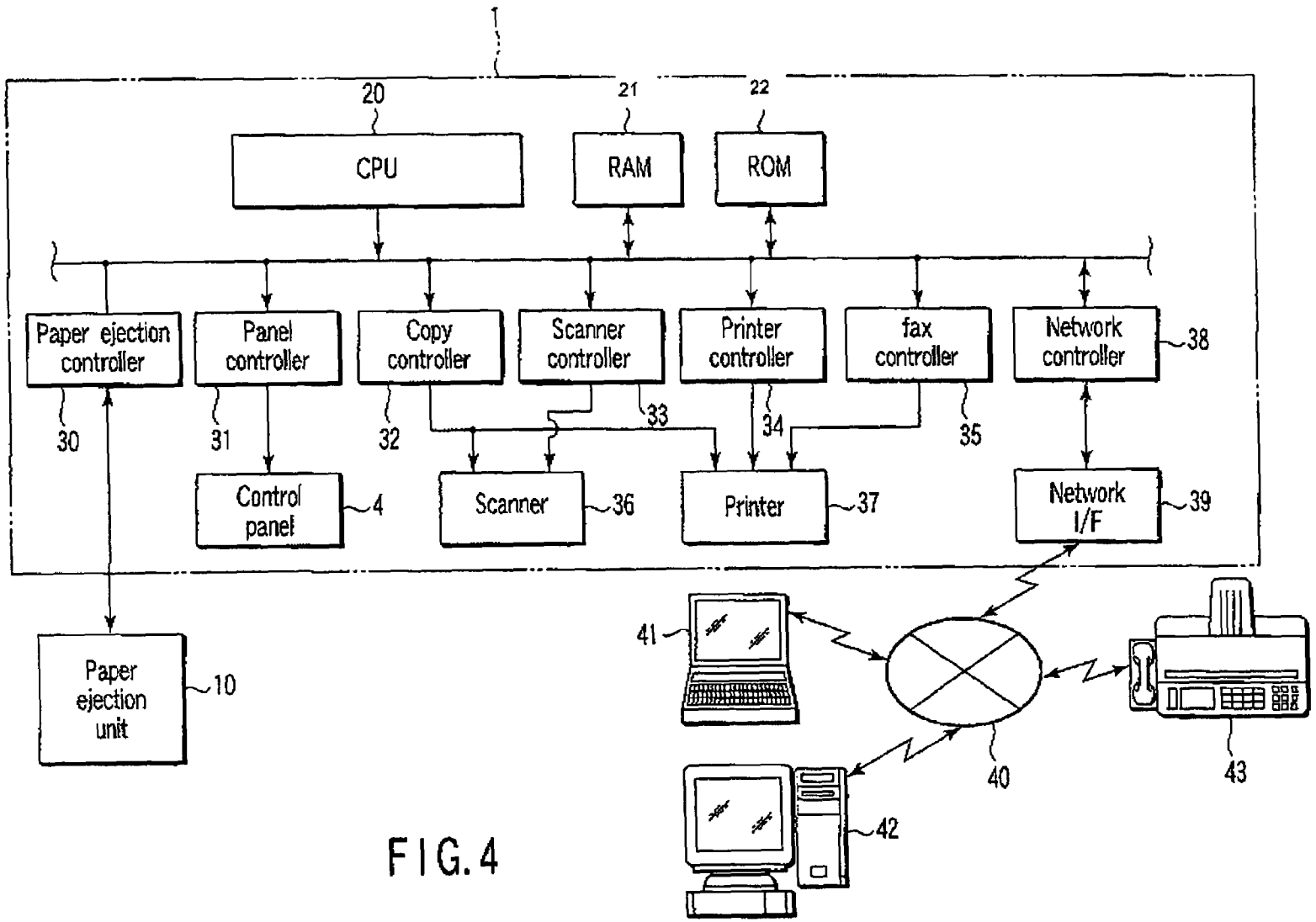
FIG. 4 is a block diagram of the control circuit of each embodiment of the invention.

FIG. 4 shows the control circuit in the main body 1.

A CPU 20 is connected with a RAM 21, a ROM 22, a paper ejection controller 30, a panel controller 31, a copy controller 32, a scanner controller 33, a printer controller 34, a facsimile (fax) controller 35, and a network controller 38. The RAM 21 is used for storing various data. The ROM 22 stores various control programs necessary to operate the main body 1. The paper ejection controller 30 controls the paper ejection unit 10. The panel controller 31 controls the control panel 4.

The copy controller 32 controls the ordinary copy function using a scanner 36 and a printer 37. The scanner controller 33 controls the scanner function such as a network scanner using the scanner 36. The printer controller 34 controls the printer function such as a network printer using the printer 37. The facsimile controller 35 controls the facsimile function using the printer 36.

The network controller 38 controls data transfer with external units through a network interface 39. The network interface 39 is provided with a LAN board and fax modem, and connected to external units such as personal computers 41 and 42 and a facsimile 43 through an external communication line 40.

The CPU 20 has the following means (1)–(6) as main functions.

(1) A detection means for detecting whether one of the trays 11 and 12 of the paper ejection unit 10 is set at the position corresponding to the paper ejection port 8.

(2) A first control means for starting printing by the copy function while holding the trays 11 and 12 at the current positions, if the state key 4*c* is not turned on and the upper tray 11 for copying is detected by the detection means, when a copy job for printing by the copy function is entered.

(3) A second control means for starting the printing by the copy function after setting the upper tray 11 for copying at the position corresponding to the paper ejection port 8, if the state key 4*c* is not turned on and the lower tray 12 for the printer is detected by the detection means, when a copy job is entered.

(4) A third control means for starting the printing by the copy function while holding the trays 11 and 12 at the current positions, if the state key 4*c* is turned on, when a copy job is entered.

(5) A fourth control means for starting the printing by the printer function while holding the trays 11 and 12 at the current positions, if the lower tray 12 for the printer is detected by the detection means, when a print job for printing by the printer function is entered.

(6) A fifth control means for starting the printing by the printer function after setting the lower tray 12 for the printer at the position corresponding to the paper ejection port 8, if the upper tray 11 for copying is detected by the detection means, when a print job is entered.

Figure 5:
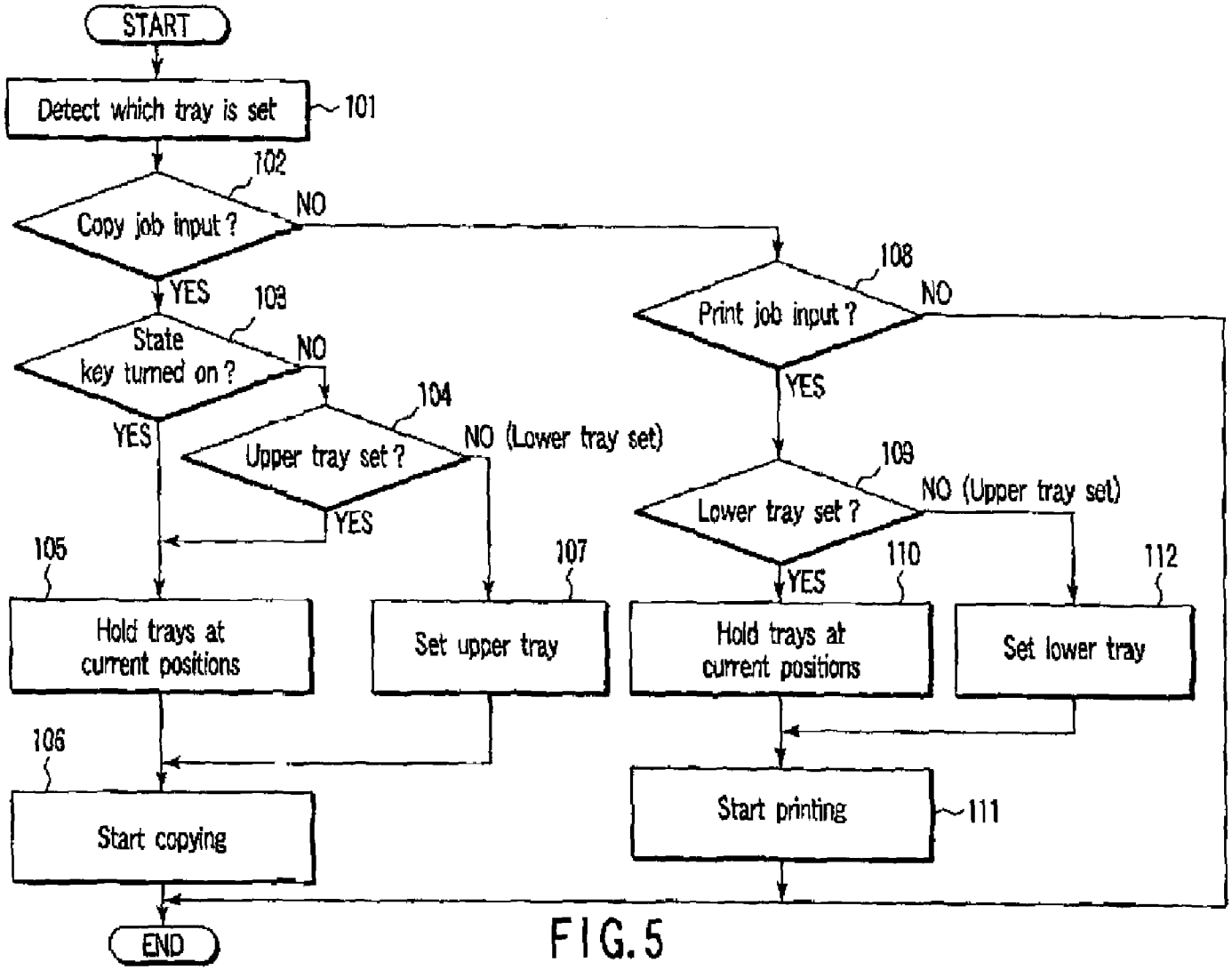
FIG. 5 is a flowchart for explaining the effects of a first embodiment.

Next, explanation will be given on the effects with reference to the flowchart of FIG. 5.

Whether one of the trays 11 and 12 of the paper ejection unit 10 is set at the position corresponding to the paper ejection port 8 is detected (step 101).

If the state key 4*c* on the control panel 4 is not turned on (NO in step 103) and the setting of the upper tray 11 is detected (YES in step 104) when a copy job is entered from the control panel 4 (YES in step 102), printing by the copy function is started (step 106) while the trays 11 and 12 of the paper ejection unit 10 are held at the current positions (step 105). The printed paper sheet P is ejected to the upper tray 11 for copying.

If the state key 4*c* is not turned on (NO in step 103) and the setting of the lower tray 12 is detected (NO in step 104) when a copy job is entered (YES in step 102), the upper tray 11 is set at the position corresponding to the paper ejection port 8 (step 107). After this setting, printing by the copy function is started (step 106). The printed paper sheet P is ejected to the upper tray 11 for copying.

If the state key 4*c* is turned on (YES in step 103) when a copy job is entered (YES in step 102), printing by the copy function is started while the trays 11 and 12 of the paper ejection unit 10 are held at the current positions (step 105). The printed paper sheet P is ejected to the preset upper tray 11 or lower tray 12, If the setting of the lower tray 12 for the printer is detected (YES in step 109) when a print job is input to the main body 1 from the external personal computer 41 or 42 through the communication line 40 (YES in step 105), printing by the printer function is started (step 111) while the trays 11 and 12 of the paper ejection unit 10 are held at the current positions (step 110). Namely, the image data input from the personal computer 41 or 42 is printed on the paper sheet P, and the printed paper sheet P is ejected to the lower tray 12 for the printer.

If the setting of the upper tray 11 for copying is detected (YES in step 109) when a print job is entered (YES in step 108), the lower tray 12 for the printer is set at the position corresponding to the paper ejection port 8 (step 112). After this setting, printing by the printer function is started (step 111). The printed paper sheet P is ejected to the lower tray 12 for the printer.

Printing by the copy function may be executed immediately after the printing by the printer function. In this case, by turning on the state key 4*c* on the control panel, the printing will be immediately started without waiting for the movement of the trays 11 and 12. This is convenient for a busy user. As the trays 11 and 12 are not moved, the power consumption is reduced and noises is prevented. As the number of times the trays 11 and 12 are moved is decreased, the life of the paper ejection unit 10 is prolonged.

[2] A second embodiment will be explained.

The CPU 20 has the following means (11)–(20) as main functions.

(11) A detection means which detects which tray 11 or 12 of the paper ejection unit 10 is set at the position corresponding to the paper ejection port 8.

(12) A first control means which starts printing by the copy function while holding the trays 11 and 12 of the paper ejection unit 10 at the current positions, if the state key 4*c* is not turned on and the upper tray 11 for copying is detected by the above detection means, when a copy job for printing by the copy function is entered.

(13) A second control means which starts printing by the copy function after setting the tray 11 for copying at the position corresponding to the paper ejection port 8, if the state key 4*c* is not turned on and the lower tray 12 for the printer is detected by the above detection means, when a copy job is entered.

(14) A third control means which starts printing by the copy function while holding the trays 11 and 12 of the paper ejection unit 10 at the current positions, if the state key 4*c* is turned on, when a copy job is entered.

(15) A fourth control means which starts printing by the printer function while holding the trays 11 and 12 at the current positions, if the lower tray 12 for the printer is specified by the external personal computer 41 or 42 and the lower tray 12 for the printer is detected by the above detection means, when a print job for printing by the printer function is entered.

(16) A fifth control means which starts printing by the printer function after setting the lower tray 12 at the position corresponding to the paper ejection port 8, if the lower tray 12 for the printer is specified by the external personal computer 41 or 42 and the upper tray 11 for copying is detected by the above detection means, when a print job is entered.

(17) A sixth control means which starts printing by the printer function while holding the trays 11 and 12 at the current position, if the upper tray 11 for copying is specified by the external personal computer 41 or 42 and the upper tray 11 for copying is detected by the above detector, when a print job is entered.

(18) A seventh control means which starts printing by the printer function after setting the upper tray 11 at the position corresponding to the paper ejection port 8, if the upper tray 11 for copying is specified by the external personal computer 41 or 42 and the lower tray 12 for the printer is detected by the above detection means, when a print job is entered.

(19) An eighth control means which starts printing by the printer function after forming a route to eject the printed paper sheet P to the main body tray 7, if the main body tray 7 is specified by the external personal computer 41 or 42, when a print job is entered.

(20) A ninth control means which starts printing by the printer function while holding the trays 11 and 12 at the current positions, if the current position is specified by the external personal computer 41 or 42, when a print job is entered.

Figure 6:
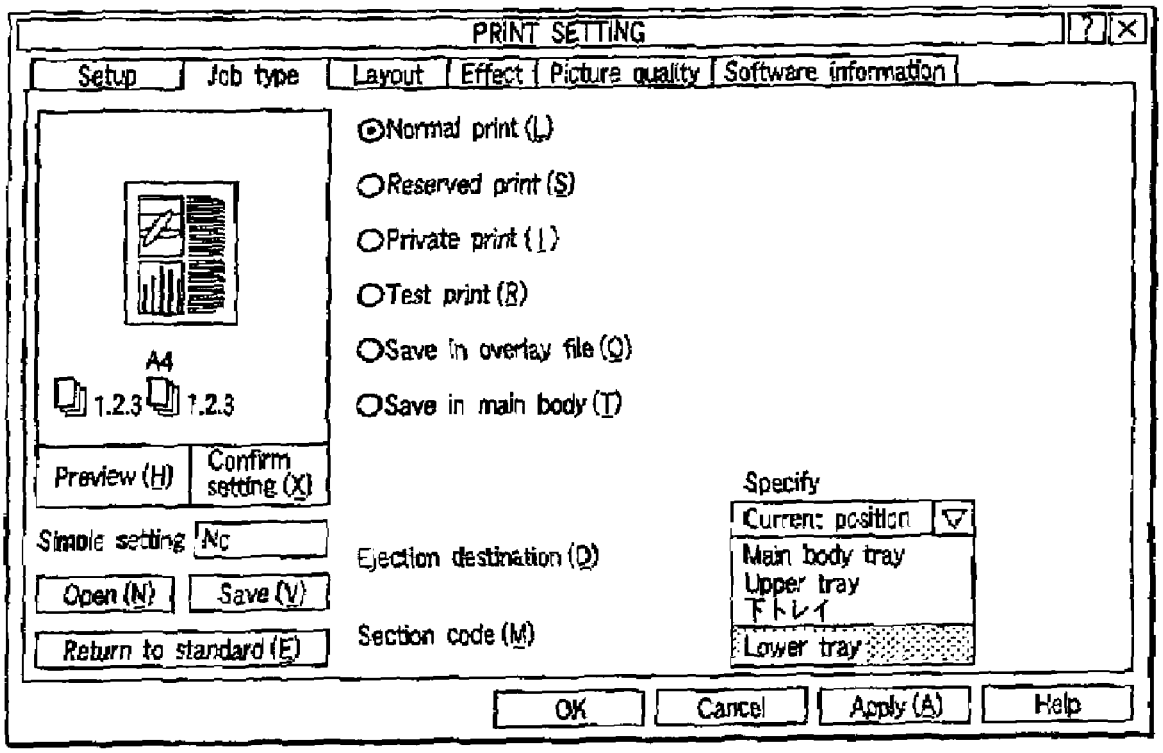
FIG. 6 is a view showing the print setting screen in a second embodiment.

The personal computers 41 and 42 have a print setting screen shown in FIG. 6 as a section to specify selectively one of the upper tray 11, lower tray 12 and main body tray 7, or the current positions of the trays 11 and 12. A window for this selective specification is provided in the lower right on the print setting screen.

The other configuration is the same as the first embodiment, and an explanation will be omitted.

Figure 7:
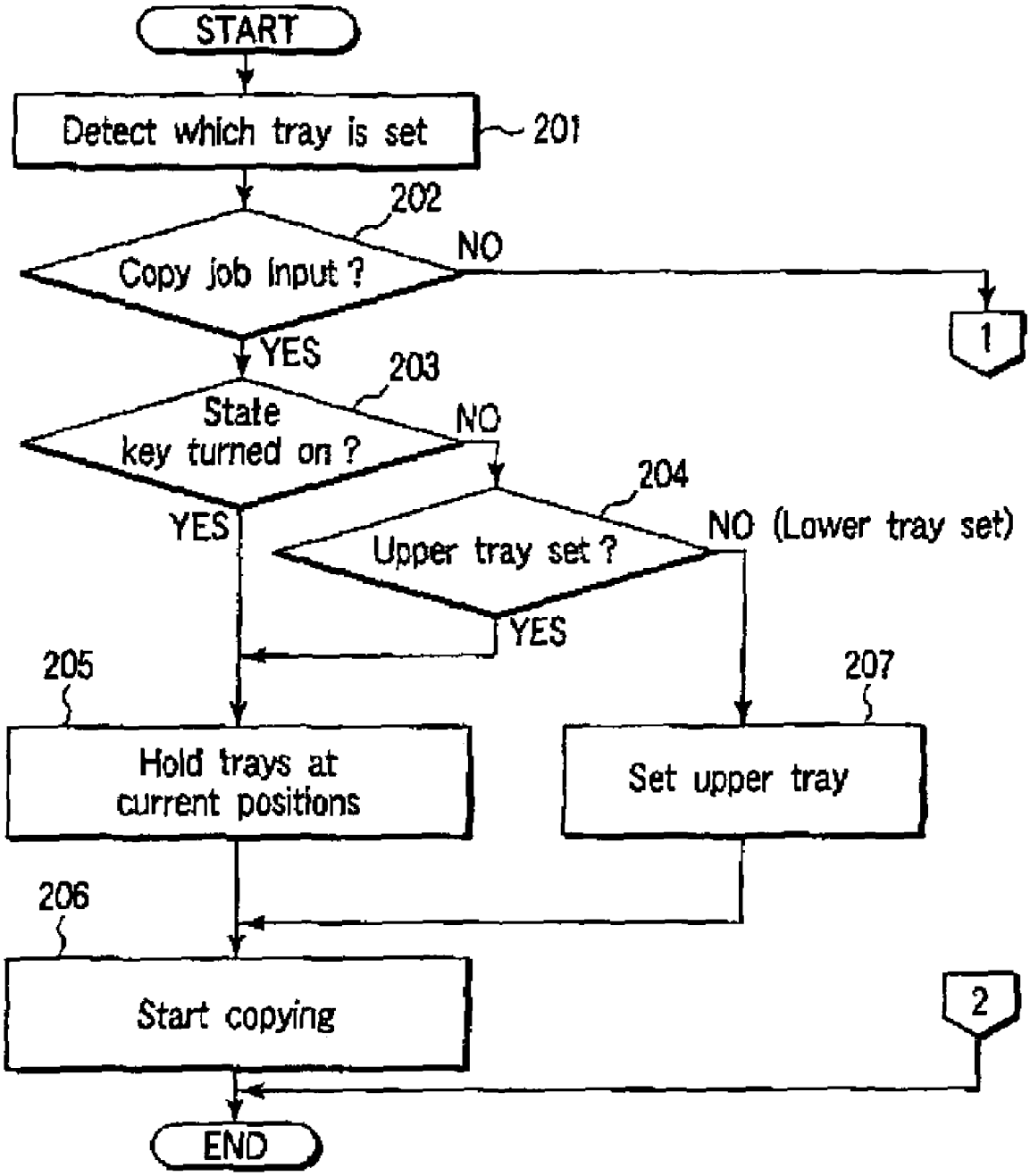
FIG. 7 is a flowchart for explaining the effects of a second embodiment.
Figure 8:
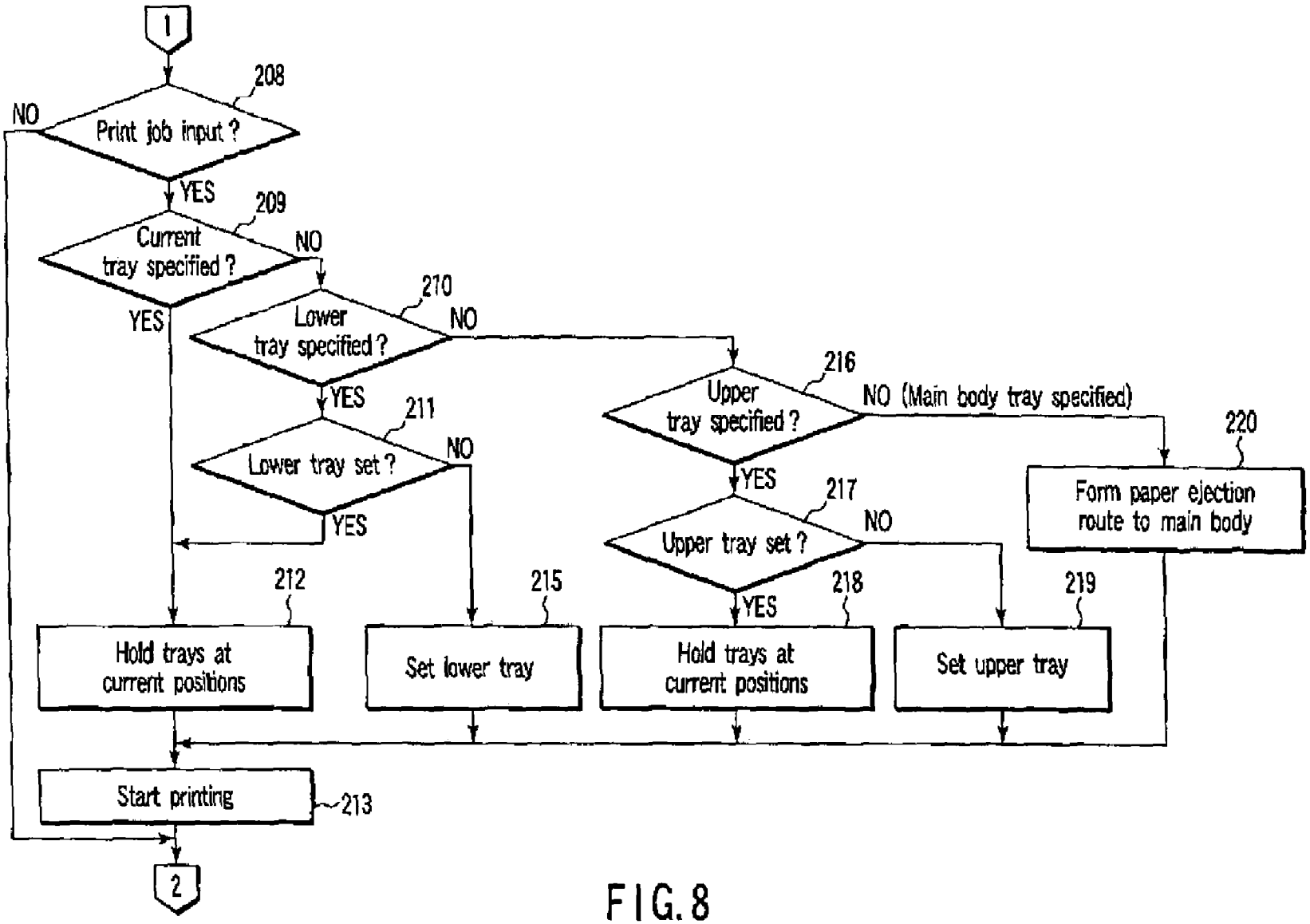
FIG. 8 is a flowchart following the chart of FIG. 7.

Now, the effects will be explained with reference to the flowcharts of FIGS. 7 and 8.

Whether one of the trays 11 and 12 of the paper ejection unit 10 is set at the position corresponding to the paper ejection port 8 is detected (step 201).

If the state key 4*c* on the control panel 4 is not turned on (NO in step 203) and the setting of the upper tray 11 is detected (YES in step 204) when a copy job is input from the control panel 4 (YES in step 202), printing by the copy function is started (step 206) while the trays 11 and 12 of the paper ejection unit 10 are held at the current positions (step 205). The printed paper sheet P is ejected to the upper tray 11 for copying.

If the state key 4*c* on the control panel 4 is not turned on (NO in step 203) and the setting of the lower tray 12 is detected (NO in step 204) when a copy job is input (YES in step 202), the upper tray 11 is set at the position corresponding to the paper ejection port 8 (step 207). After this setting, printing by the copy function is started (step 206). The printed paper sheet P is ejected to the upper tray 11 for copying.

If the state key 4*c* on the control panel 4 is turned on (YES in step 203) when a copy job is input (YES in step 202), printing by the copy function is started (step 206) while the trays 11 and 12 of the paper ejection unit 10 are held at the current positions (step 205). The printed paper sheet P is ejected to the preset upper tray 11 or lower tray 12. In this case, printing is started immediately without waiting for movement of the trays 11 and 12.

If the lower tray 12 is specified by the personal computer 41 or 42 (NO in step 209, YES in step 210) and the setting of the lower tray 12 is detected (Yes in step 211) when a print job is input to the main body 1 from the external personal computer 41 or 42 through the communication line 40 (YES in step 208), printing by the printer function is started (step 213) while the trays 11 and 12 are held at the current positions (step 212). Namely, the image data input from the personal computer 41 or 42 is printed on the paper sheet P, and the printed paper sheet P is ejected to the lower tray 12.

If the lower tray 12 is specified by the personal computer 41 or 42 (NO in step 209, YES in step 210) and the setting of the upper tray 12 is detected (NO in step 211) when a print job is entered (YES in step 208), the lower tray 12 is set at the position corresponding to the paper ejection port 8 (step 215). After this setting, printing by the printer function is started (step 213). The printed paper sheet P is ejected to the lower tray 12.

If the upper tray 11 is specified by the personal computer 41 or 42 (NO in step 209, NO in step 210, YES in step 216) and the setting of the upper tray 11 is detected (YES in step 217) when a print job is entered (YES in step 208), printing by the printer function is started (step 213) while the trays 11 and 12 are held at the current positions (step 218). The printed paper sheet P is ejected to the upper tray 11.

If the upper tray 11 is specified by the personal computer 41 or 42 (NO in step 209, NO in step 210, YES in step 216) and the setting of the lower tray 12 is detected (NO in step 217) when a print job is entered (YES in step 208), the upper tray 11 is set at the position corresponding to the paper ejection port 8 (step 219). After this setting, printing by the printer function is started (step 213). The printed paper sheet P is ejected to the upper tray 11.

If the main body tray 7 is specified by the personal computer 41 or 42 (NO in step 209, NO in step 210, NO in step 216) when a print job is entered (YES in step 208), a paper ejection route to the main body tray 7 is formed (step 220). After this forming, printing by the printer function is started (step 213). The printed paper sheet P is ejected to the main body tray 7.

If the current position is specified by the personal computer 41 or 42 (YES in step 209) when a print job is entered (YES in step 208), printing by the printer function is started (step 213) while the trays 11 and 12 are held at the current positions (step 212). The printed paper sheet P is ejected to the preset tray 11 or tray 12. By specifying the current position in this way, printing is started without waiting for movement of the trays 11 and 12. As the trays 11 and 12 are not moved, the power consumption is reduced and noises is prevented. As the number of times the trays 11 and 12 are moved is decreased, the life of the paper ejection unit 10 is increased.

Printing by the copy function may be executed immediately after the printing by the printer function. In this case, the printing is started without waiting for movement of the trays 11 and 12, by turning on the state key 4*c* on the control panel 4. This is convenient for a busy user

[3] A third embodiment will be explained.

The state key 4*c* is eliminated from the control panel 4.

The CPU 20 has the following means (31)–(36) as main functions.

(31) A detection means which detects which tray 11 or 12 of the paper ejection unit 10 is set at the position corresponding to the paper ejection port 8.

(32) A first control means which starts printing by the copy function while holding the trays 11 and 12 at the current positions, if the number of copies is more than "two" and the upper tray 11 for copying is detected by the above detection means, when a copy job for printing by the copy function is entered.

(33) A second control means which starts printing by the copy function after setting the upper tray 11 for copying at the position corresponding to the paper ejection port 8, if the number of copies is more than "two" and the lower tray 12 for the printer is detected by the above detection means, when a copy job is entered.

(34) A third control means which starts printing by the copy function while holding the trays 11 and 12 at the current positions, if the number of copies is "one", when a copy job is entered.

(35) A fourth control means which starts printing by the printer function while holding the trays 11 and 12 at the current positions, if the lower tray 12 for the printer is detected by the above detection means, when a print job for printing by the printer function is entered.

(36) A fifth control means which starts printing by the printer function after setting the lower tray 12 for the printer at the position corresponding to the paper ejection port 8, if the upper tray 11 for copying is detected by the above detection means, when a print job is entered.

The other configuration is the same as the first embodiment, and an explanation will be omitted.

Figure 9:
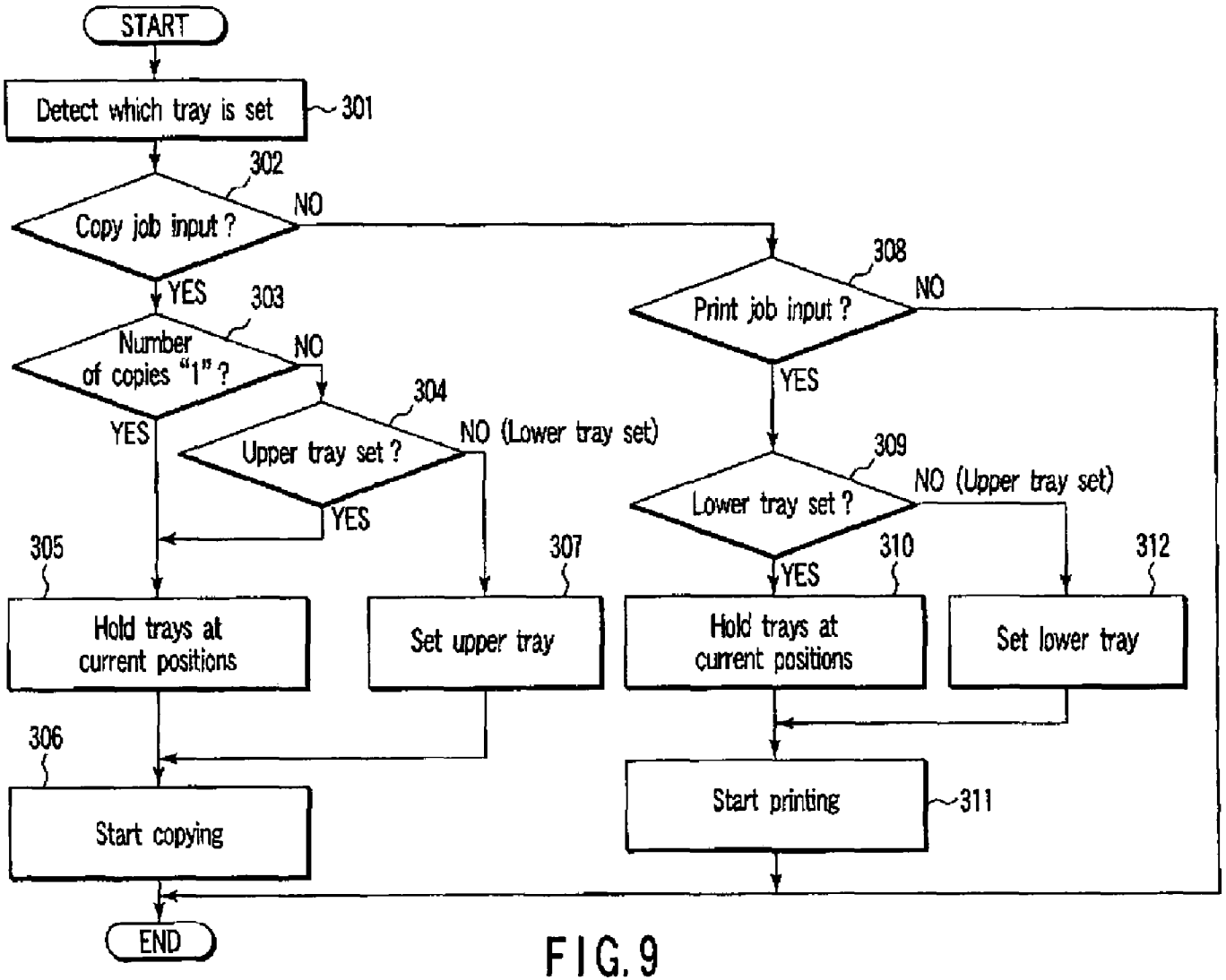
FIG. 9 is a flowchart for explaining the effects of a third embodiment.

Now, the effects will be explained with reference to the flowchart of FIG. 9.

Whether one of the trays 11 and 12 of the paper ejection unit 10 is set at the position corresponding to the paper ejection port 8 is detected (step 301).

If the number of copies is two or more (NO in step 303) and the setting of the upper tray 11 is detected (YES in step 304) when a copy job is input from the control panel 4 (YES in step 302), printing by the copy function is started (step 306) while the trays 11 and 12 of the paper ejection unit 10 are held at the current positions (step 305). The printed paper sheet P is ejected to the upper tray 11 for copying.

If the number of copies is two or more (NO in step 303) and the setting of the lower tray 12 is detected (NO in step 204) when a copy job is input (YES in step 302), the upper tray 11 is set at the position corresponding to the paper ejection port 8 (step 307). After this setting, printing by the copy function is started (step 306). The printed paper sheet P is ejected to the upper tray 11 for copying.

If the number of copies is "one" (YES in step 303) when a copy job is input (YES in step 302), printing by the copy function is immediately started (step 306) while the trays 11 and 12 of the paper ejection unit 10 are held at the current positions (step 305). The printed paper sheet P is ejected to the preset upper tray 11 or lower tray 12.

If the setting of the lower tray 12 for the printer is detected (YES in step 309) when a print job is input to the main body 1 from the external personal computer 41 or 42 through the communication line 40 (YES in step 308), printing by the printer function is started (step 311) while the trays 11 and 12 of the paper ejection unit 10 are held at the current positions (step 310). Namely, the image data input from the personal computer 41 or 42 is printed on the paper sheet P, and the printed paper sheet P is ejected to the lower tray 12 for the printer.

If the setting of the upper tray 11 for copying is detected (YES in step 309) when a print job is entered (YES in step 308), the lower tray 12 for the printer is set at the position corresponding to the paper ejection port 8 (step 312). After this setting, printing by the printer function is started (step 311). The printed paper sheet P is ejected to the lower tray 12 for the printer.

Printing by the copy function may be executed immediately after the printing by the printer function. In this case, as long as the number of copies is "one", the printing is immediately started without waiting for movement of the trays 11 and 12. This is convenient for a busy user. As the trays 11 and 12 are not moved, the power consumption is reduced and noises is prevented. As the number of times the trays 11 and 12 are moved is decreased, the life of the paper ejection unit 10 is increased.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a main body having a copy function of printing an image read from a document on a paper sheet, a printer function of printing an externally input image on a paper sheet, and a paper ejection port to eject a printed paper sheet;

a paper ejection unit which has a first tray and a second tray for receiving a paper sheet ejected from the paper ejection port, and moves the trays selectively to the positions corresponding to the paper ejection port;

a detection part configured to detect which one of the trays of the paper ejection unit is set at the position corresponding to the paper ejection port;

a CPU to perform functions, including starting printing by the copy function while holding the trays of the paper ejection unit at the current positions, if the number of copies is more than one and the first tray is detected by the detection part when a copy job for printing by the copy function is entered;

starting printing by the copy function after setting the first tray at the position corresponding to the paper ejection port, if the number of copies is more than one and the second tray is detected by the detection section when a copy job for printing by the copy function is entered;

starting printing by the copy function while holding the trays of the paper ejection unit at the current positions, if the number of copies is one when a copy job for printing by the copy function is entered;

starting printing by the printer function while holding the trays of the paper ejection unit at the current positions, if the second tray is detected by the detection part when a print job for printing by the printer function is entered; and starting printing by the printer function after setting the second tray at the position corresponding to the paper ejection port, if the first tray is detected by the detection part when a print job for printing by the printer function is entered.

2. The image forming apparatus according to claim 1, further comprising a main body tray to receive the printed paper sheet in the main body.

3. An image forming apparatus comprising:

a main body having a copy function to print an image read from a document on paper sheets, a printer function to print an externally input image on paper sheets, and a paper ejection port to eject printed paper sheets;

a paper ejection unit to receive paper sheets ejected from the paper ejection port, the paper ejection unit having a first tray and a second tray, the paper ejection unit selectively moving the trays to the positions corresponding to the paper ejection port;

a detection part configured to detect which one of the trays of the paper ejection unit is set at the position corresponding to the paper ejection port;

a CPU to perform functions, including starting the copy function printing while holding the trays of the paper ejection unit at their current positions when the number of copies is more than one and the first tray is detected by the detection part when a copy job for printing by the copy function is entered;

starting the copy function printing after setting the first tray at a position corresponding to the paper ejection port when the number of copies is more than one and the second tray is detected by the detection part when a copy job for printing by the copy function is entered;

starting the copy function printing while holding the trays of the paper ejection unit at their current positions when the number of copies is one when a copy job for printing by the copy function is entered;

starting printing the printer function while holding the trays of the paper ejection unit at their current positions when the second tray is detected by the detection part and when a print job for printing by the printer function is entered; and starting the printer function printing after setting the second tray at a position corresponding to the paper ejection port when the first tray is detected by the detection part and when a print job for printing by the printer function is entered.

4. The image forming apparatus of claim 3, further comprising:

a main body tray to receive the printed paper sheets in the main body.

5. A method in an image forming apparatus including a main body having a copy function to print an image read from a document on paper sheets, a printer function to print an externally input image on paper sheets, and a paper ejection port to eject printed paper sheets, the method comprising:

receiving paper sheets in a paper ejection unit, the paper sheets ejected from the paper ejection port, the paper ejection unit having a first tray and a second tray;

selectively moving the trays of the paper ejection unit to the positions corresponding to the paper ejection port;

detecting in a detection part which of the trays of the paper ejection unit is set at the position corresponding to the paper ejection port;

starting printing by the copy function while holding trays of the paper ejection unit at current tray positions when a number of copies is more than one and a first tray is detected by the detection part when a copy job for printing by the copy function is entered;

starting printing by the copy function after setting the first tray at a position corresponding to a paper ejection port when the number of copies is more than one and the second tray is detected by the detection part when the copy job for printing by the copy function is entered;

starting printing by the copy function while holding the trays of the paper ejection unit at the current tray positions when the number of copies is one when the copy job for printing by the copy function is entered;

starting printing by the printer function while holding the trays of the paper ejection unit at the current tray positions when the second tray is detected by the detection part when the print job for printing by the printer function is entered; and starting printing by the printer function after setting the second tray at the position corresponding to the paper ejection port when the first tray is detected by the detection part when the print job for printing by the printer function is entered.

6. The method in an image forming apparatus according to claim 5 further comprising:

receiving the printed paper sheet in a main body tray of the main body.

7. A method in an image forming apparatus including a main body having a copy function to print an image read from a document on paper sheets, a printer function to print an externally input image on paper sheets, and a paper ejection port to eject printed paper sheets, the method comprising:

receiving in a paper ejection unit paper sheets ejected from the paper ejection port, the paper ejection unit having a first tray and a second tray;

selectively moving the trays in the paper ejection unit to positions corresponding to the paper ejection port;

detecting in a detection part which one of the trays of the paper ejection unit is set at the position corresponding to the paper ejection port;

starting the copy function printing while holding the trays of the paper ejection unit at their current positions when the number of copies is more than one and the first tray is detected by the detection part when a copy job for printing by the copy function is entered;

starting the copy function printing after setting the first tray at a position corresponding to the paper ejection port when the number of copies is more than one and the second tray is detected by the detection section when the copy job for printing by the copy function is entered;

starting the copy function printing while holding the trays of the paper ejection unit at their current positions when the number of copies is one when the copy job for printing by the copy function is entered;

starting the printer function while holding the trays of the paper ejection unit at their current positions when the second tray is detected by the detection part and when the print job for printing by the printer function is entered; and starting the printer function printing after setting the second tray at a position corresponding to the paper ejection port when the first tray is detected by the detection part and when a print job for printing by the printer function is entered.

8. The method in an image forming apparatus of claim 7 further comprising:

receiving the printed paper sheets in a main body tray of the main body.

* * * * *

UNITED STATES PATENT AND TRADEMARK OFFICE

CERTIFICATE OF CORRECTION

PATENT NO. : 7,233,751 B2
APPLICATION NO. : 10/921578
DATED : June 19, 2007
INVENTOR(S) : Nishida It is certified that error appears in the above-identified patent and that said Letters Patent is hereby corrected as shown below:

Title page: Attorney, Agent, or Firm, replace “Sravaiya” with --Sarvaiya--.

Column 4 line 25, replace “105” with --108--.

Signed and Sealed this

Thirty-first Day of July, 2007

JON W. DUDAS
*Director of the United States Patent and Trademark Office*